US008317671B1

(12) United States Patent
Zoeckler

(10) Patent No.: US 8,317,671 B1
(45) Date of Patent: Nov. 27, 2012

(54) PAPERBOARD CARTONS WITH LAMINATED REINFORCING RIBBONS AND METHOD OF MAKING SAME

(75) Inventor: Michael D. Zoeckler, Roswell, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 0 days.

(21) Appl. No.: 09/559,704

(22) Filed: Apr. 27, 2000

(51) Int. Cl.
*B31B 1/72* (2006.01)

(52) U.S. Cl. ..... 493/89; 493/94; 493/379; 493/382; 493/393

(58) Field of Classification Search ..... 493/52, 493/59, 60, 62, 65, 67, 68, 76, 77, 78, 84, 493/89, 94, 379, 382, 393, 97
See application file for complete search history.

(56) References Cited

U.S. PATENT DOCUMENTS

| | | | | | |
|---|---|---|---|---|---|
| 504,551 | A | * | 9/1893 | Brandstaedter | 493/112 |
| 516,983 | A | * | 3/1894 | Beery | 493/112 |
| 997,263 | A | * | 7/1911 | Bird | 493/128 |
| 1,402,261 | A | | 1/1922 | Smith | |
| 1,564,374 | A | | 12/1925 | Smith | |
| 1,600,396 | A | * | 9/1926 | Campbell | |
| 1,627,811 | A | | 5/1927 | Smith | |
| 1,627,812 | A | | 5/1927 | Smith | |
| 1,693,023 | A | | 11/1928 | Cleaves | |
| 1,745,385 | A | | 2/1930 | Smith | |
| 1,762,702 | A | * | 6/1930 | Smith | 229/182 |
| 1,762,703 | A | | 6/1930 | Smith | |
| 1,782,611 | A | * | 11/1930 | Hackett et al. | 493/116 |
| 1,784,317 | A | * | 12/1930 | Stokes | 229/87.18 |
| 1,880,288 | A | | 10/1932 | Stokes | |
| 1,922,506 | A | | 8/1933 | Stokes | |
| 1,976,211 | A | | 10/1934 | Bickford | |
| 2,008,608 | A | * | 7/1935 | Claff | 493/62 |
| 2,048,693 | A | | 7/1936 | Grupe | |
| 2,095,389 | A | | 10/1937 | Kondolf | |

(Continued)

FOREIGN PATENT DOCUMENTS

CA 2205401 11/1995

(Continued)

OTHER PUBLICATIONS

Notification of Reason for Refusal—Japanese Application No. 2001-580062.

(Continued)

*Primary Examiner* — Christopher Harmon
(74) *Attorney, Agent, or Firm* — Womble Carlyle Sandridge & Rice, LLP

(57) ABSTRACT

A method of making reinforced paperboard cartons comprises the steps of advancing a web of paperboard along a path and progressively laminating at least one ribbon of reinforcing material to the advancing web of paperboard. The ribbon of reinforcing material, which also may be paperboard, has a width less than the width of the web of paperboard and is applied with adhesive at a selected location across the width of the web. The web and its laminated ribbon are cut into sheets of a predetermined size and the sheets are die-cut and scored with fold lines to form carton blanks. The carton blanks are subsequently formed into cartons for receiving articles, the laminated reinforcing material providing reinforcement in selected portions of the cartons. Multiple ribbons and multiple layers of ribbons may be laminated to the web in respective selected locations to provide reinforcement in more than one portion of the cartons. Reinforced cartons and carton blanks made by the method also are provided.

25 Claims, 5 Drawing Sheets

U.S. PATENT DOCUMENTS

| | | | | | |
|---|---|---|---|---|---|
| 2,145,682 | A | | 1/1939 | Bergstein | |
| 2,177,894 | A | | 10/1939 | Lakso | |
| 2,285,356 | A | | 6/1942 | Ridderstrom | |
| 2,307,142 | A | | 1/1943 | Lee | |
| 2,502,117 | A | * | 3/1950 | Anderson | 156/250 |
| 2,558,918 | A | | 7/1951 | Zinn, Jr. | |
| 2,646,914 | A | | 7/1953 | Claff et al. | |
| 2,751,964 | A | | 6/1956 | Reynolds | |
| 2,772,718 | A | | 12/1956 | Magnuson | |
| 2,776,072 | A | | 1/1957 | Forrer | |
| 2,776,608 | A | | 1/1957 | Fischer et al. | |
| 2,862,425 | A | * | 12/1958 | Swaim et al. | 229/176 |
| 2,933,228 | A | * | 4/1960 | Reynolds Guyer | 229/199 |
| 2,969,906 | A | | 1/1961 | Claff et al. | |
| 3,113,492 | A | | 12/1963 | Foss | |
| 3,113,898 | A | | 12/1963 | Tross | |
| 3,149,768 | A | | 9/1964 | Aller | |
| 3,179,023 | A | | 4/1965 | Hoff | |
| 3,194,474 | A | | 7/1965 | Rumberger | |
| 3,240,611 | A | | 3/1966 | Williams | |
| 3,252,385 | A | | 5/1966 | Balocca | |
| 3,379,102 | A | | 4/1968 | James et al. | |
| 3,411,689 | A | | 11/1968 | Brackett | |
| 3,468,734 | A | | 9/1969 | Shields | |
| 3,526,566 | A | | 9/1970 | McIlvain | |
| 3,590,699 | A | * | 7/1971 | Foley et al. | 493/110 |
| 3,608,047 | A | | 9/1971 | Wiggins | |
| 3,653,578 | A | | 4/1972 | Wood | |
| 3,741,859 | A | | 6/1973 | Wandel | |
| 3,750,538 | A | * | 8/1973 | Confer | 493/335 |
| 3,830,140 | A | | 8/1974 | Rausing et al. | |
| 3,831,929 | A | | 8/1974 | Hellmer | |
| 3,878,771 | A | * | 4/1975 | Malcolm | 493/67 |
| 3,913,822 | A | | 10/1975 | Heaps, Jr. | |
| 3,933,568 | A | | 1/1976 | Schmermund | |
| 3,945,870 | A | | 3/1976 | Johnsen | |
| 4,034,907 | A | | 7/1977 | Engdahl, Jr. | |
| 4,059,220 | A | | 11/1977 | Lorenz | |
| 4,146,418 | A | | 3/1979 | Walter | |
| 4,177,715 | A | * | 12/1979 | Meyers | 493/59 |
| 4,177,936 | A | | 12/1979 | Ford, Jr. et al. | |
| 4,196,035 | A | | 4/1980 | Reil | |
| 4,232,074 | A | | 11/1980 | Chavannes | |
| 4,260,442 | A | | 4/1981 | Ford et al. | |
| 4,437,850 | A | | 3/1984 | Ono | |
| 4,452,837 | A | | 6/1984 | Clausen et al. | |
| 4,559,259 | A | | 12/1985 | Cetrelli | |
| 4,560,429 | A | | 12/1985 | Credali et al. | |
| 4,567,070 | A | | 1/1986 | Karass | |
| 4,586,643 | A | | 5/1986 | Halabisky et al. | |
| 4,608,038 | A | | 8/1986 | Virta et al. | |
| 4,741,728 | A | * | 5/1988 | Bakx | 493/131 |
| 4,785,696 | A | | 11/1988 | Martiny | |
| 4,860,774 | A | | 8/1989 | Becker | |
| 4,866,913 | A | | 9/1989 | Rebischung | |
| 4,905,864 | A | | 3/1990 | Balin | |
| 4,935,082 | A | | 6/1990 | Bennett et al. | |
| 4,946,540 | A | | 8/1990 | Mitchard | |
| 5,012,825 | A | | 5/1991 | Lindemann et al. | |
| 5,055,151 | A | | 10/1991 | Duffy | |
| 5,073,162 | A | | 12/1991 | Campbell et al. | |
| 5,087,498 | A | | 2/1992 | Nedblake et al. | |
| 5,097,651 | A | * | 3/1992 | Decottignies et al. | 53/451 |
| 5,108,355 | A | * | 4/1992 | Walsh | 493/89 |
| 5,147,480 | A | * | 9/1992 | Lang | 156/64 |
| 5,163,891 | A | | 11/1992 | Goldsborough et al. | |
| 5,169,082 | A | | 12/1992 | Da Silva et al. | |
| 5,211,618 | A | * | 5/1993 | Stoltz | 493/110 |
| 5,224,919 | A | | 7/1993 | Walsh | |
| 5,230,736 | A | | 7/1993 | Schnodewind | |
| 5,236,778 | A | | 8/1993 | Landis et al. | |
| 5,242,720 | A | | 9/1993 | Blake | |
| 5,251,819 | A | | 10/1993 | McHugh | |
| 5,393,295 | A | | 2/1995 | Knecht | |
| 5,418,027 | A | | 5/1995 | Conboy | |
| 5,426,130 | A | | 6/1995 | Thurber | |
| 5,447,270 | A | * | 9/1995 | McNown | 229/199 |
| 5,551,938 | A | * | 9/1996 | Stone | 229/225 |
| 5,736,470 | A | | 4/1998 | Schneberger et al. | |
| 5,746,871 | A | * | 5/1998 | Walsh | 156/250 |
| 5,772,569 | A | * | 6/1998 | Janhonen | 493/333 |
| 5,791,239 | A | | 8/1998 | Lauderbaugh et al. | |
| 5,845,841 | A | | 12/1998 | Canning | |
| 5,944,252 | A | | 8/1999 | Connelly et al. | |
| 6,015,084 | A | | 1/2000 | Mathieu et al. | |
| 6,221,192 | B1 | | 4/2001 | Walsh | |
| 6,332,488 | B1 | | 12/2001 | Walsh | |
| 6,637,646 | B1 | | 10/2003 | Muise et al. | |
| 2001/0022211 | A1 | | 9/2001 | Walsh | |
| 2001/0048022 | A1 | | 12/2001 | Zoeckler | |
| 2002/0022560 | A1 | | 2/2002 | Zoeckler et al. | |

FOREIGN PATENT DOCUMENTS

| | | | |
|---|---|---|---|
| CA | 2229180 | | 8/1996 |
| CA | 2346103 | | 4/2000 |
| DE | 195 06 647 | A1 | 9/1996 |
| EP | 0 231 082 | A2 | 8/1987 |
| JP | 49-112779 | | 10/1974 |
| JP | 8-310525 | | 11/1996 |
| JP | 11100066 | A | 4/1999 |
| WO | WO 97/06059 | | 2/1997 |
| WO | WO 01/94125 | A1 | 12/2001 |

OTHER PUBLICATIONS

Supplementary European Search Report—EP 01 92 3042.

* cited by examiner

PAPERBOARD CARTONS WITH LAMINATED REINFORCING RIBBONS AND METHOD OF MAKING SAME

BACKGROUND OF THE INVENTION

1. Field of the Invention

This invention relates generally to article packaging and more specifically to the fabrication of paperboard cartons into which a plurality of articles can be packaged for transport and sale.

2. Description of the Related Art

Paperboard cartons of various design and construction have long been used by the packaging industry to package a wide variety of articles such as canned and bottled drinks, food items, detergents, and more. In general, paperboard cartons are erected or converted from paperboard blanks that are die-cut or rotary-cut from long webs of paperboard as the paperboard is drawn progressively from large rolls. Fold lines are scored in the blanks to define the various panels of the cartons and to aid in the conversion of the blanks into their final carton shapes. In some cases, such as in beer and soft drink packaging, the blanks are pre-glued and provided to packager in the form of substantially flat knocked down sleeves that are erected in a packaging machine into open ended cartons for receiving articles. In other cases, the blanks are provided in a completely flat configuration, in which case the blanks typically are folded around groups of articles and glued by the packaging machine. In either case, the conversion of blanks usually is performed at the time of packaging by specialized conversion stations that are part of large continuous packaging machines. In this way, the flat or pre-glued and knocked down paperboard blanks can be shipped economically to the packager in palletized stacks.

When making paperboard carton blanks from a web of paperboard, the web usually is pre-cut to a specified predetermined width from a wider web of paperboard stock. The pre-cutting of the web to width generally takes place at the paper mill. The width of the web in each case is dictated by the size and shape of the cartons to be made from the web and is specified to the paper mill by a carton fabricator. For example, a web of paperboard stock may have a width of 64 inches whereas a particular carton blank may require a web 48 inches wide. In such an example, a strip of paperboard 16 inches wide (or two strips that total 16 inches in width) typically will be cut from the web of paperboard stock by the paper mill to form the required 48 inch-wide web. These strips, known in the industry as "trim," traditionally have had reduced value and in some cases are sold at low cost for secondary uses such as the making of shirt collar stiffeners used in the garment industry. In general, the creation of trim in the process of making paperboard web has long been a problem for paperboard manufacturers.

Occasionally, errors by paperboard manufacturers result in rolls of paperboard web that may be substandard for a variety of reasons and thus not usable in the fabrication of paperboard cartons. In other cases, paperboard web manufactured for a particular customer may not meet specifications and thus cannot readily be used. Such substandard and-off-spec paperboard is known in the industry as "cull" and also has had reduced value, sometimes being reconstituted into pulp for making new paper. In general, there has been little use for trim and cull in the paperboard carton making industry.

In many packaging applications, the cartons into which articles are packaged must exhibit enhanced strength at least in selected regions to contain the articles securely. This is particularly true in cases where the articles are relatively heavy and are stacked atop one another in their cartons for shipment and sale. For example, canned and bottled beverages, which typically may be packaged in groups of 6, 12, or 24, are inherently relatively heavy and typically are stacked several cartons high on pallets for shipment to retail stores. The cartons into which these beverages are packed therefore must be strong enough to hold the groups of cans or bottles securely together and to resist tearing or "blowing out" even when under the substantial weight of several layers of stacked cartons. In other applications, such as, for example, cartons of boxed fruit drinks, the cartons themselves must provide at least some of the strength and rigidity necessary to resist crushing when layers of cartons are stacked atop one another. This is because the individual drink containers lack the rigidity of bottles or cans and cannot themselves bear the entire weight of a stack of cartoned fruit drinks.

In applications such as these, traditional paperboard cartons have sometimes proven inadequate to provide the required strength and rigidity. As a result, many packagers have turned to a carton material known in the industry as micro-flute, which is a corrugated paper product. In general, micro-flute is fabricated from a core of paper material formed with a large number of relatively small corrugations sandwiched between facing sheets of flat paper. Micro-flute does tend to provide the strength and rigidity required in many packaging applications; however, it also has significant inherent problems and shortcomings including its generally higher price compared to paperboard. In addition, carton blanks made of micro-flute can be more expensive in some weights to ship than paperboard blanks because their greater thickness limits the number of blanks that can be stacked on standard sized pallet. Further, in some cases, specialized conversion machinery is required to convert the blanks to cartons, increasing the cost of the packaging process. Finally, the printing of high quality graphics on micro-flute has sometimes proven to be difficult. Thus, micro-flute has not provided a completely satisfactory solution as a carton making material in packaging applications where enhanced carton strength and rigidity is required.

Attempts have been made to improve the strength and rigidity of paperboard cartons to provide a viable alternative to micro-flute where added strength and rigidity are required. These attempts have included laminating two or more webs or sheets of standard thickness paperboard together to create thicker multi-ply paperboard from which carton blanks can be cut. However, while this approach increases the strength and rigidity of resulting cartons, it essentially results in a doubling of the paperboard required per carton and a consequent increase in material and shipping costs. Further, the formation of fold lines in and the folding of multiple ply paperboard cartons is problematic due to the added thickness of paperboard that must be folded. For these and other reasons, such multi-layer laminated paperboard has not proven to be an acceptable alternative to micro-flute.

Other attempts to provide alternatives to micro-flute have included the separate fabrication of custom stiffening inserts, which are installed in individual cartons after the cartons are converted from carton blanks. Such inserts have been used, for example, in detergent cartons to provide added strength for stacking and an internal moisture barrier and in beverage cartons to provide separators. However, installing inserts requires expensive specialized machinery, increases material and packaging costs, and can significantly slow the packaging process.

A problem with cartons in general, including micro-flute and paperboard cartons, is that they tend to tear and fail in areas of particularly high stress such as in certain corners of the cartons where folded panels meet. Such tears, once started, often can do spread, resulting in the separation of carton panels and ultimately in carton blow-out. Attempts to address this problem have included providing double folding flaps and/or tongues in carton blanks to reinforce the corners and, in some cases, gluing special corner reinforcements in cartons to inhibit tearing. Such attempts have not been completely successful.

In some situations, a product manufacturer may specify that cartons into which products are to packaged be printed on the inside in addition to the printing of logos and graphics on the outside of the carton. For example, a manufacturer may want to print contest rules, product instructions, special incentive coupons, or the like on the inside of product cartons. In the past, such interior printing has required that relatively expensive and time-consuming two-sided printing techniques be used to print both sides of a web from which the carton blanks are cut. Further, since interior surfaces of cartons generally are not coated for printing, the quality and character of printing available for interior carton surfaces has been limited.

A need therefore exists for an improved paperboard carton that provides the strength and rigidity of cartons made from micro-flute at a competitive cost. A related need exists for an efficient and cost effective method of making such paperboard cartons that uses traditional paperboard carton fabrication machinery and that does not substantially increase material costs associated with the fabrication process. Further needs exist for more efficient methods of providing paperboard carton inserts such as stiffeners and dividers and for providing higher quality printing visible on the interior surfaces of cartons where such printing is desired. It is to the provision of a method of making a paperboard carton and a resulting carton that addresses these and other needs and that overcomes the problems of the prior art that the present invention is primarily directed.

SUMMARY OF THE INVENTION

Briefly described, the present invention, in a preferred embodiment thereof, comprises a method of making reinforced paperboard cartons having enhanced strength and rigidity similar to that of micro-flute in selected regions where strength and rigidity are required. The method comprises the steps of advancing a web of paperboard along a path. The web of paperboard has a predetermined width according to the size of cartons to be made and preferably is drawn from a large roll of paperboard. The web of paperboard may or may not be pre-printed on the side that will become the outside of the finished carton with, for example, logos and graphics, according to application specific requirements. The web also may be printed on both sides if desired.

As the web of paperboard is advanced along the path, one or more ribbons of reinforcing material, each having a width less than the width of the paperboard web, is progressively applied to the web. Each ribbon preferably is applied with adhesive to the side of the web that will become the inside of the finished cartons and is positioned at a predetermined location across the width of the web. The location of each ribbon is selected to provide multiple layers or laminations of material in specific regions of finished cartons where enhanced strength and/or rigidity will be required such as, for example, in the side walls of the carton. Preferably, the ribbons of reinforcing material also are formed of paperboard and most preferably are pre-cut or slit to desired widths from paperboard trim or cull that otherwise may have reduced value. The ribbons are drawn from rolls that are pre-positioned to locate the ribbons properly on the web, advanced along and adjacent to the path of the web, supplied with adhesive on one side, and progressively brought into engagement with and compressed against the advancing paperboard web to adhere the ribbons to the web. In one embodiment, one or more of the ribbons may be pre-printed or on both sides with application specific indicia that ultimately will be exposed on the inside of finished cartons.

After the reinforcing ribbons are laminated to the advancing web, the web may be cut into sheets of a predetermined size. The sheets subsequently may be die-cut and scored with fold lines as required to form carton blanks defining the various panels and tabs that ultimately will become the walls of finished cartons. The carton blanks may be palletized and shipped to packagers, where the blanks are converted into cartons and packed with articles such as, for example, beverage containers or food items. When converted to cartons, the JD previously positioned and applied paperboard reinforcing ribbons form multiple layers or laminations of paperboard in selected portions of the cartons such as, for example, in their sides, where enhanced structural integrity is required. By appropriately selecting, sizing, and positioning the reinforcing ribbons, paperboard cartons having strength and rigidity comparable or superior to that provided by cartons made of micro-flute are obtained. Further, through judicious use of trim and cull in making the reinforcing ribbons, paperboard cartons made by the method of the present invention can be economically viable alternatives to cartons made of micro-flute.

In addition to providing paperboard cartons comparable in strength to micro-flute cartons, the present invention offers possibilities that are not obtainable with micro-flute. For example, the reinforcing ribbons of the present invention may be pre-printed on one side with high-quality graphics and indicia that is visible on the inside of finished cartons, all without requiring a two-sided printing process. Further, only a portion of one or more ribbons may be adhered to the paperboard web, with another portion being inwardly foldable to define interior carton structures such as stiffeners and dividers without the need for the insertion of a separate liner. Additional advantages are also provided, as will become more apparent below.

Thus, a unique reinforced paperboard carton and method of its manufacture is now provided that successfully addresses the problems and shortcomings of the prior art. The carton has structural integrity comparable to cartons previously made of micro-flute but is made of traditional paperboard material, which is easily converted to cartons in packaging machines with standard conversion machinery. The carton is economically competitive with cartons formed of micro-flute because of the unique use of trim and cull in forming the reinforcing ribbons and because the method of making the carton blanks can be practiced with existing paperboard fabrication machinery. The forgoing and other features, objects, and advantages of the invention will become more apparent upon review of the detailed description of the preferred embodiments set forth below when taken in conjunction with the accompanying drawing figures, which are briefly described as follows.

DETAILED DESCRIPTION OF THE PREFERRED EMBODIMENTS

Figure 3:
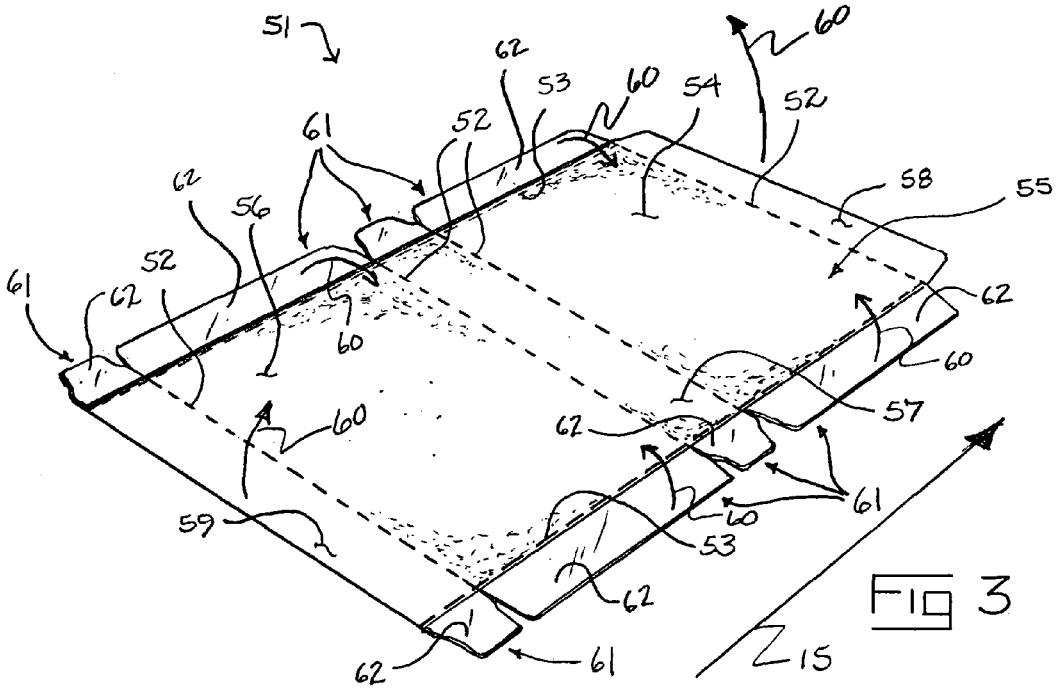
FIG. 3 is a perspective view of a possible configuration of a paperboard carton blank that embodies principles of the invention.

As mentioned above, carton blanks may be provided in the form of pre-glued knocked down sleeves or completely flat sheets depending upon the type of packaging operation in which they are to be used. The carton blank shown in FIG. 3 is of the former type and typically is partially folded and glued at the carton manufacturing location and shipped to a packager in the form of a knocked down sleeve. This sleeve, then, is erected by the packaging machinery into an open-ended carton sleeve into which product is inserted before the carton sleeve is sealed shut. This type of carton typically is used in most beer and soft drink bottling plants. The carton shown in FIG. 8, on the other hand, typically is formed from a carton blank that is shipped completely flat, folded around product in the packaging machine, and glued shut. This latter type of carton blank is different than the former in that the gluing of the carton to form a sleeve is done at the product production and/or packaging facility rather than at the carton fabricating facility. The present invention will be described for the most part in terms of making a flat carton blank typified by the carton of FIG. 8. However, it should be understood that the present invention is not limited to the fabrication of flat carton blanks, but also includes the fabrication of pre-glued knocked down carton sleeve blanks as well as other types of carton blanks.

Figure 1:
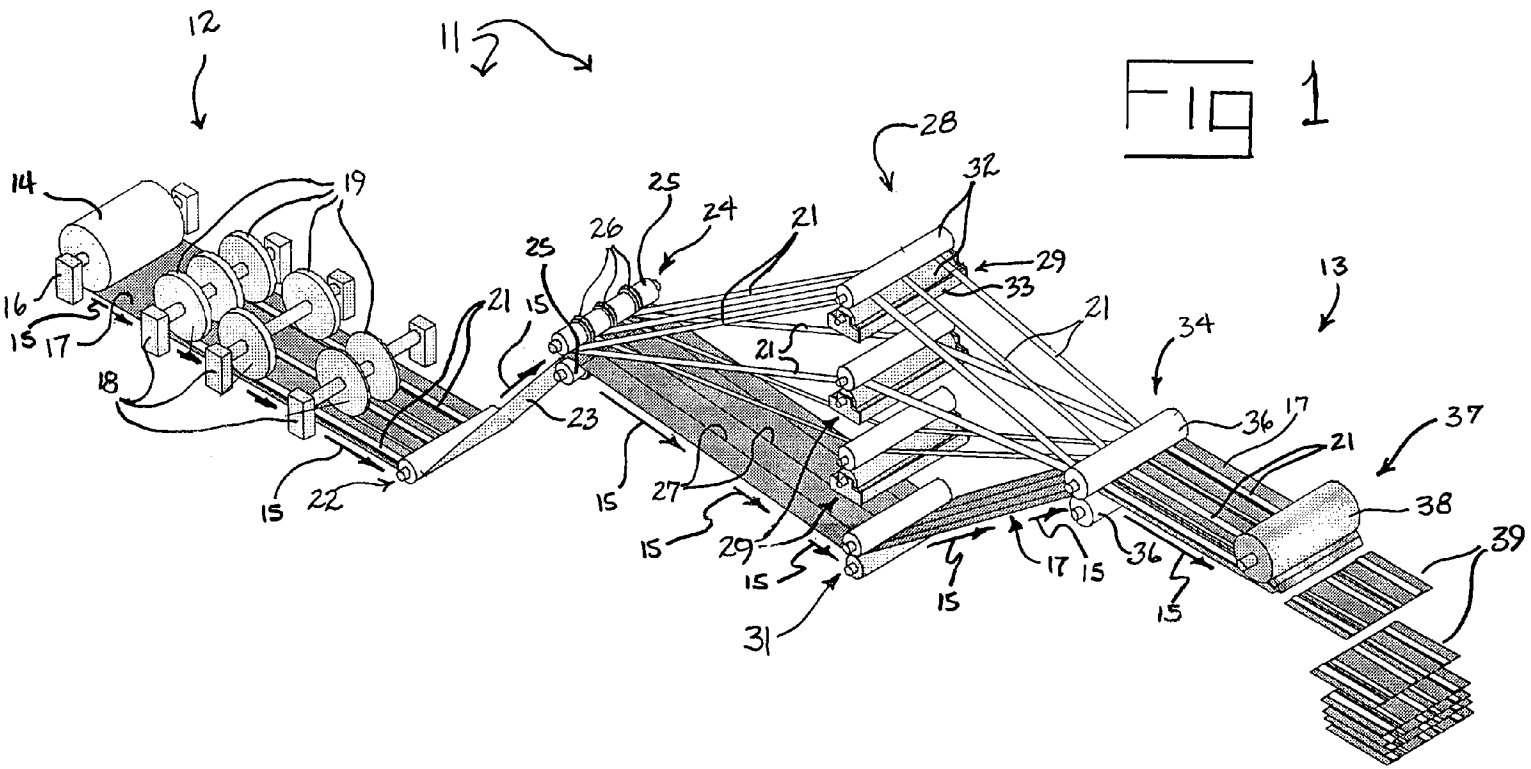
FIG. 1 is a perspective illustration of a method of making reinforced paperboard carton blanks that embodies principles of the present invention in a preferred form.

Referring now in more detail to the drawings, wherein like numerals refer, where appropriate, to like parts throughout the several views, FIG. 1 illustrates a fabrication line 11 for making reinforced paperboard carton blanks according to a preferred embodiment of the invention. The various stations along the fabrication line 11 are illustrated in simplified functional form for clarity of description. It will be understood, however, that the fabrication line and the machinery making up the various stations therealong are standard machinery in the paperboard making industry and are well known by those of skill in the art. Further, a detailed description of the machinery that makes up the fabrication line is not necessary to a complete disclosure and understanding of the invention. Accordingly, this machinery is not described in detail here.

The fabrication line 11 in FIG. 1 has an upstream end 12 and a downstream end 13 and the various elements used in the making of paperboard blanks according to the invention flow along paths in a direction extending generally from the upstream end toward the downstream end of the line. A large roll 14 of a paperboard web 17 is rotatably mounted on a pair of mandrels 16 located at the upstream end of the fabrication line 11. In carrying out the method of the invention, the paperboard web 17, which is pre-cut to a required width as described above, is drawn from the roll 17 and advanced along a path, generally indicated by arrows 15, that extends past the various stations of the fabrication line. In one embodiment, the paperboard web 17 may be preprinted on one side, as indicated at 23, with indicia such as application specific graphics, trademarks, and logos; however, such preprinting is not desired is some applications and should not be considered a requirement or limitation of the invention. Alternatively, the web may printed on both sides, which is desirable for some applications.

Mandrels 18, three of which are illustrated in FIG. 1, are disposed at spaced locations along the path 15 adjacent the upstream end 12 of the fabrication line 11. Ribbons 21 of reinforcing material, each having a width less than the width of the paperboard web 17, are rolled onto relatively narrow rolls 19 and the rolls 19 are rotatably mounted on the mandrels 18. The ribbons 21 of reinforcing material are progressively drawn from the rolls 19 along with the web 17 and initially are disposed atop and move along the path 15 with the web 17. Each of the mandrels 18 may carry multiple rolls 19 of ribbons 21 and each of the rolls 19 may be positioned at any desired location across the width of the mandrel. Further, each of the ribbons 21 of reinforcing material may be cut to any desired width less than the width of the paperboard web 17.

As the web 17 and ribbons 21 are drawn from their respective rolls and advance along the path 15, the ribbons are positioned, according to the locations of their rolls 19 on mandrels 18, at predetermined locations across the width of the web 17. In the configuration illustrated in FIG. 1, for example, the rolls 19 are positioned such that a double layer of ribbons 21 is located adjacent each of the opposed edge portions of the web, a single ribbon is located in the central portion of the web, and a pair of relatively narrow ribbons are disposed on either side of the centrally located ribbon. By appropriately positioning the rolls 19 on the mandrels 18, virtually any placement and configuration of ribbons 21 of reinforcing material may be obtained, as described in more detail below.

The reinforcing material from which the ribbons 21 are formed may be any of a variety of appropriate materials such as, for example, thin plastic, fiberglass, woven or non-woven webs, or foam, and these and other materials are considered to be within the scope of the invention. Preferably, however, the ribbons also are made of paperboard and most preferably are cut or slit from paperboard trim or cull that otherwise has little or no commercial value. The invention will be described hereinafter in terms of ribbons of paperboard reinforcing material for ease and clarity of understanding. It should be understood, however, that the term "paperboard" when used in this context is intended to encompass and include any material with the physical and mechanical attributes necessary to provide the requisite reinforcing properties.

As the paperboard web 17 and ribbons 21 advance along the path 15, they move through a traditional de-curling station 22, where the paperboard of the web and ribbons is flattened and any curl that may have been induced by rolling the paperboard onto rolls 14 and 19 is removed. From the de-curling station 22, the web and ribbons advance further along the path 15 to a scoring station 24, which includes a pair of rollers 25 along which one or more scoring wheels 26 are disposed. The scoring wheels 26 are selectively positioned across the width of the rollers 25 to score the web 17 with longitudinally extending fold lines 27, along which carton blanks made by the method of the invention ultimately will be folded when converted into cartons.

As described in more detail below, some of the fold lines 27 may be located adjacent or along an edge of a reinforcing ribbon 21. In such cases, these fold lines preferably are carefully located a predetermined short distance from the edge of the ribbon so that the ribbon will not adversely affect or interfere with the folding of the paperboard along the fold lines. The scoring wheels 26 shown in FIG. 1 are located to provide substantially equally spaced fold lines across the width of the paperboard web 17. It will be understood, however, that any number of fold lines at any number of locations across the web, or no fold lines, determined by the desired final shape and size of cartons being made, are possible and within the scope of the invention.

With the fold lines 27 scored in the paperboard web 17, the web 17 advances along the path 15 to a pair of guide rollers 31 and the paperboard reinforcing ribbons 21 diverge from the web 17 and advance to a gluing station 28 for receiving adhesive. In the illustrated embodiment, the gluing station 28 comprises an array of traditional adhesive applicators 29, each having a pair of nip rollers 32 between which one or more paperboard reinforcing ribbons pass. The lower nip roller 32 of each of the applicators 29 is partially immersed in an appropriate liquid adhesive contained within a flooded nip bath 33. As the paperboard reinforcing ribbons 21 pass between the nip rollers, a layer of adhesive is transferred from the lower nip roller of each pair to the bottom side (as seen in FIG. 1) of each ribbon 21. An array of three adhesive applicators 29 are illustrated in FIG. 1 for applying adhesive to the seven paperboard reinforcing ribbons in the illustrated embodiment. Fewer or more than three adhesive applicators 29 may be used as necessary depending upon the number and configuration of reinforcing ribbons required in a particular application.

Means other than nip rollers and nip baths for applying adhesive to the ribbons may be used to apply adhesive to the ribbons such alternative means include adhesive sprays, which commonly are used in the paperboard industry. Adhesive spraying mechanisms for use in the paperboard industry are commercially available and may be obtained, for example, from the Nordson Company. In any case, adhesive may be applied to the reinforcing ribbons 21 in a continuous coat, a discontinuous coat, a stitch-glued pattern, a strand, or otherwise. Preferably, the adhesive is applied in such a way as to minimize the amount of adhesive required to provide adequate paperboard to paperboard bonding. In one embodiment of the present invention, adhesive is applied along only one side of one or more of the ribbons to produce a finished carton having inwardly foldable internal structures such as separators and stiffeners, as described in more detail below.

The paperboard web 17 advances from the guide rollers to the compression station 34, which includes a pair main compression rollers 36, that also may function as pull rollers. Likewise, the adhesive bearing paperboard ribbons 21 advance from the gluing station 28 toward the compression station 34 and toward the paperboard web 17. At the compression station 34, the paperboard ribbons 21 and paperboard web 17 pass between the main compression rollers 36. The compression rollers 36 are set to compress the reinforcing ribbons 21 and the web 17 together with sufficient pressure to bond the adhesive and thus the ribbons to the web, or to other underlying ribbons in cases where multiple laminations of ribbons are to be applied to the web 17. In this way, the ribbons are progressively applied to the advancing web of paperboard at selected locations across the width of the web, as determined by the placement of rolls 19 on mandrels 18.

From the compression station 34, the paperboard web 17 with scored fold lines 27 and with the paperboard reinforcing ribbons 21 laminated thereto proceeds toward the downstream end 13 of the fabrication line 11 and toward a cutting station 37. In the illustrated embodiment, the cutting station 37 includes a traditional rotary knife assembly 38, which rotates to cut the web 17 across its width into rectangular sheets of a predetermined size. Each sheet has a width equal to the width of the paperboard web 17 and a length determined by the settings and operation of the rotary knife assembly 38. Means other than a rotary knife such as, for example, a traversing knife assembly or a platen cutter may be substituted for the rotary knife of the illustrated embodiment and these and other means for cutting the web should be considered equivalent to the illustrated rotary knife assembly.

Once the web 17 is cut into sheets 39, the sheets may be stacked and delivered to a die cutter, where the sheets are cut in a standard platen die-cutting operation to form carton blanks having the various tabs and panels necessary to form paperboard cartons embodying principles and features of the present invention.

As an alternative to cutting the web 17 into sheets 39 and subsequently die-cutting the sheets 39 to form paperboard blanks, the rotary knife assembly 33 in FIG. 1 may be replaced with a platen die cutter or rotary inline die cutter, in which case the web 17 is cut immediately into carton blanks at the downstream end of the fabrication line 11 and the step of first cutting the web into sheets is eliminated. In either case, once the carton blanks are cut, they may be palletized and shipped to product packagers, where the blanks are converted into cartons and packed with articles in the usual way.

When the blanks are converted, the ribbons of reinforcing paperboard laminated to the carton blanks form multiple layers of paperboard in selected portions of the cartons and thus reinforce the cartons in these portions. The locations of the ribbons are carefully determined in advance such that, when the carton blank is converted to a carton, the ribbons and thus reinforcement is provided in selected portions of the cartons such as, for example, in their side walls, where added strength and/or rigidity are required. Reinforced paperboard cartons made by the method of this invention have been found to exhibit strength and rigidity in the reinforced portions that is comparable or superior to that of cartons made from microflute.

With the forgoing specific example in mind, it will be appreciated that, in one embodiment, the present invention is a unique method of making reinforced paperboard cartons. The method includes the steps of advancing a web of paperboard along a path, the web of paperboard having a width. At least one ribbon of reinforcing material having a width less than the width of the paperboard web is progressively applied, preferably with adhesive, to the advancing web at a predetermined position across its width. The web with its applied reinforcing ribbon is cut to form carton blanks and the carton blanks are formed into cartons for receiving articles, the ribbon of reinforcing material providing reinforcement in selected portions of the cartons where added strength is required.

Figure 2:
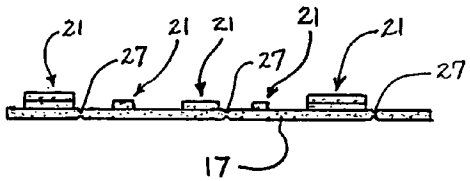
FIG. 2 is a cross-sectional view showing the profile of a carton blank made by the method illustrated in FIG. 1.

FIG. 2 is a cross-sectional view of the web 17 of FIG. 1 as it appears after the reinforcing ribbons 21 have been bonded to the web, such as just beyond the compression station 34. While this particular configuration may or may not correspond to that of an actual carton, it is presented along with FIG. 1 to illustrate clearly some of the variety of possible sizes and placements of reinforcing ribbons 21 and scored fold lines 27 that may be obtained through the method of the invention. In FIG. 2, the reinforcing ribbons 21 are applied at predetermined locations across the width of the web 17 such that a double layer of ribbons is disposed adjacent each edge portion of the web and a single ribbon is located intermediate the edges of the web. A relatively thin ribbon is located on either side of the centrally located ribbon and the web is scored to form longitudinally extending fold lines 27 spaced a short distance from the edges of some of the reinforcing ribbons.

FIG. 3 illustrates one possible configuration of an actual carton blank that may be formed by the method of the invention. The carton blank 51 has a base sheet 55 of paperboard material, which is a part of the continuous web of paperboard used to make the blank 51 according to the invention. The base sheet 55 has longitudinally extending fold lines 53, which were scored at a scoring station 24 of a fabrication line 11 (FIG. 1), and transversely extending fold lines 52, which were scored during the die-cutting process. The fold lines 52 and 53 define a top panel 54, a bottom panel 56, a first side panel 57, and side panel tabs 58 and 59, which overlie one another when the carton blank is converted to form a second side panel of the carton. End tabs 61 are formed outboard of the longitudinally extending fold lines 53 and the end tabs are configured to be folded inwardly along the fold lines 53 when the blank is converted to form the ends of the carton.

Paperboard reinforcing ribbons 62 are laminated to the base sheet 55 according to the method of the invention. The reinforcing ribbons 52 are positioned along and increase the effective thickness of the end tabs 61 to reinforce the end tabs and provide enhanced structural integrity in the end portions of a carton converted from the blank. During conversion of the blank 51 into a carton, the various panels and tabs of the blank are folded generally inwardly along the scored fold lines 52 and 53 as indicated by arrows 60, and selected ones of the tabs are secured together with adhesive or otherwise to form a rectangular carton to be packaged with articles. The carton, when formed, has ends defined by the end tabs 61 that are reinforced by the paperboard reinforcing ribbons 62 laminated thereto to provided enhanced strength, rigidity, and tear or blow-out resistance in the ends of the carton. Thus, when the blank 51 is converted, it forms a reinforced paperboard carton having a plurality of panels defining sides and ends of the carton an a layer of reinforcing paperboard material applied to selected ones of the panels to reinforce the carton in selected regions defined by the reinforced panels.

Figure 4:
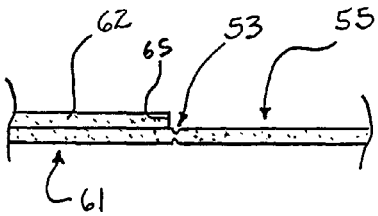
FIG. 4 is a sectional view illustrating a portion of a reinforced paperboard carton blank according to the invention and illustrating a preferred placement of a score line relative to the edge of an adjacent reinforcing ribbon.
Figure 5:
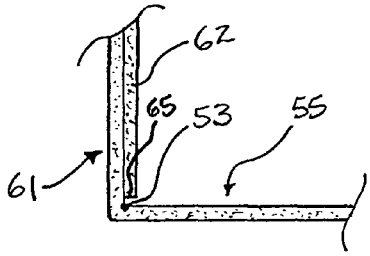
FIG. 5 is a sectional view of the portion of the reinforced paperboard carton blank of FIG. 3 with the blank folded along its fold line as it appears when the blank is converted to a carton.

FIGS. 4 and 5 illustrate a preferred placement of the reinforcing paperboard ribbons 62 with respect to adjacent fold lines 53 in FIG. 3 to insure that the added thickness of the ribbons does not interfere with the folding of the carton blank along the fold lines during conversion. Specifically, the paperboard base sheet 55 has a longitudinally extending fold line 53 that defines an end tab 61 of the carton blank. Reinforcing paperboard ribbon 62 is laminated to the base sheet 55 in the region of the end tab 61 according to the present invention to provide reinforcement as described above. The inboard edge 65 of the ribbon 62 is spaced a predetermined short distance from the fold line 53. Thus, when the sheet 55 is folded along fold line 53 during conversion to a carton, as illustrated in FIG. 5, the space between the edge 65 of the ribbon and the fold line insures that the edge of the ribbon does not impact any of the panels of the blank or otherwise interfere with the folding process.

It has been found that a distance between a fold line and an edge of a reinforcing ribbon of about 0.030 inches, which is an industry standard paperboard thickness, allows unimpeded folding of a carton blank along the fold line while having little or no effect on the structural reinforcement provided by the reinforcing ribbon. It also has been found that a distance of about 0.030 inches is easily achieved and maintained when performing the method of this invention with standard paperboard making machinery as illustrated in FIG. 1. Of course, distances other that the preferred distance may be chosen according to application specific requirements and any appropriate distance is intended to be within the scope of the invention. Further, in some applications, reinforcing ribbons may be applied at locations on the paperboard web other than adjacent to fold lines. In these cases, the distance between edges of the ribbon a and fold lines generally is not critical.

FIGS. 6*a* through 6*h* are provided to illustrate some of the many possible configurations in which reinforcing ribbons may be applied to a paperboard web using the method of the present invention. Each of these figures is a cross-sectional view of a web with reinforcing ribbons applied thereto and longitudinally extending fold lines are scored in some of the figures. It should be understood that these figures do not necessarily represent configurations corresponding to actual carton blanks, but instead are generally simplified drawings selected for clarity in describing some of the many possible configurations of reinforcing ribbons. Also in this regard, the thickness of the paperboard web and reinforcing ribbons generally is exaggerated in FIGS. 6*a* through 6*h* for clarity of illustration.

Figure 6A:
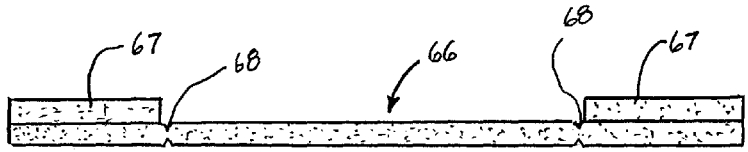
FIGS. 6*a* through 6*h* are cross-sectional views of carton blanks made by the method of the invention illustrating some of the possible configurations in which ribbons of reinforcing material may be applied to a paperboard base sheet.

In FIG. 6*a*, a the paperboard web forms a base sheet 66 having reinforcing paperboard ribbons 67 laminated thereto and extending along the opposed edge portions of the base sheet. Fold lines 68 are scored in the base sheet extending along and adjacent to the inboard edges of the reinforcing ribbons 67 to facilitate folding of the base sheet in the formation of a carton. A configuration of reinforcing ribbons similar to that of FIG. 6*a* may be selected, for example, when forming carton blanks such as the blank 51 illustrated in FIG. 3.

Figure 6B:
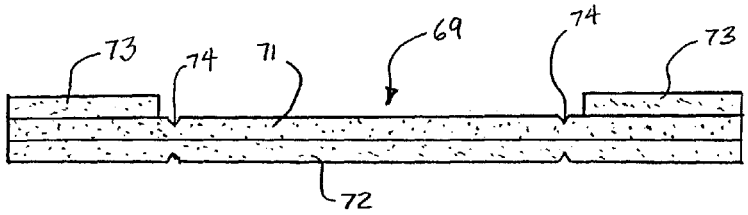

FIG. 6*b* illustrates a possible configuration similar to that of FIG. 6*a* but having a double thickness paperboard base sheet 69 formed from a first paperboard sheet 71 and a second paperboard sheet 72 laminated together. Reinforcing ribbons 73 are applied along the opposed edge portions of the base sheet 69 and fold lines 74 are scored in the base sheet to facilitate folding. Referring to FIG. 1, a configuration similar to that of FIG. 6*b* may be made by the method of the invention by, for example, mounting a second roll of full width paperboard on the mandrel 18 immediately upstream of the mandrel 16. Alternatively, a roll of double thickness laminated web may be made in advance in a separate process and mounted on mandrel 16.

Figure 6C:
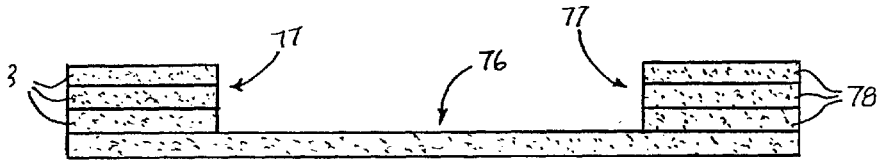

FIG. 6*c* illustrates the possibility of applying multiple laminations of reinforcing ribbons, one atop the other, to provide even more reinforcement in areas where further enhanced structural integrity may be required. In this figure, three stacked reinforcing ribbons 78 are applied along the opposed edge portions of a base sheet 76, to form multiply laminated reinforcing strips 77. Such a configuration may be formed by the method illustrated in FIG. 1 by aligning rolls 19 of reinforcing ribbons with each other on successive mandrels 18 so that the reinforcing ribbons overlie one another as they are drawn from their respective rolls. Alternatively, rolls of multi-ply pre-laminated reinforcing ribbons may be made in advance and mounted on mandrels 18 if desired to obtain similar results.

Figure 6D:
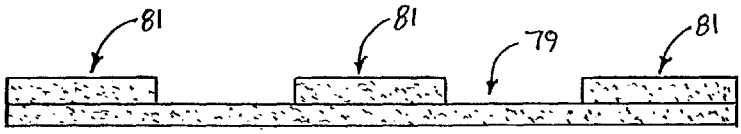

FIG. 6*d* illustrates the ability to apply multiple reinforcing ribbons at selected locations across the width of a paperboard web using the method of the invention. Here, three reinforcing ribbons 81 are applied to a paperboard base sheet 82, two along the opposed edge portions of the base sheet and one intermediate the edge portions. While the reinforcing ribbons 81 in FIG. 6*d* are illustrated with substantially the same width, it will be understood that each ribbon may have a different width and may be positioned at any desired location across the width of the base sheet according to a desired configuration and reinforcement requirements of a finished paperboard carton. Selective placement of the reinforcing ribbons is achieved in the method illustrated in FIG. 1 by selectively positioning the rolls 19 of reinforcing ribbon across the width of mandrels 18.

Figure 6E:
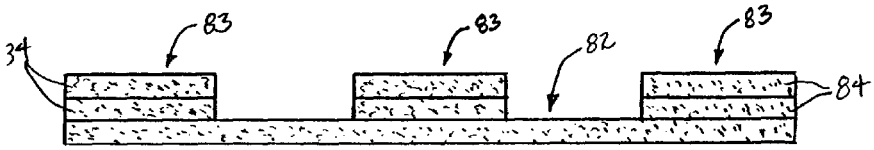

FIG. 6*e* illustrates the possibility of applying selectively positioned multi-layer reinforcing ribbons to a paperboard base sheet. Multiple layers of reinforcing ribbons 84 are applied atop each other on a base sheet 82 to form reinforcing strips 83, one extending along each of the opposed edge portions of the base sheet and one positioned intermediate the edge portions. Of course, any number of strips 83 may be applied, each of the ribbons 84 and resulting strips 83 may be any desired width, and the strips may be applied at any desired location across the width of the base sheet 82.

Figure 6F:
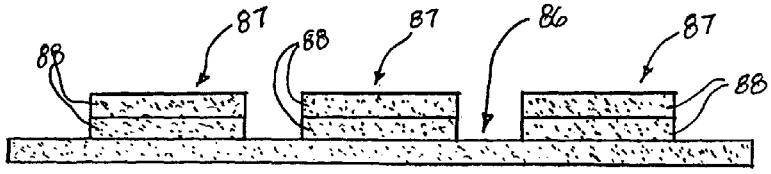

FIG. 6*f* shows the possibility of applying multiple reinforcing strips formed of multi-layer reinforcing ribbons at selected positions intermediate the edge portions of a base sheet. Multiple reinforcing strips 87 each formed of multiple layers of reinforcing ribbons 88 are applied to the base sheet at selected locations on the base sheet 86 not extending along the edge portions thereof.

Figure 6G:
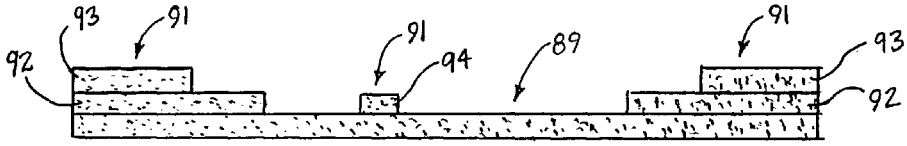

FIG. 6*g* illustrates a configuration possible with the method of the invention wherein one or more reinforcing strips 91 applied to a base sheet 89 is formed of multiple layers of reinforcing ribbons 92 and 93 the reinforcing ribbon 93 having a width less than the width of reinforcing ribbon 92. Any number of layers of ribbons may be applied in this manner to form multi-layer reinforcing strips with each ribbon of the strips having a width different from the widths of the other ribbons of the strips, according to application specific requirements. A relatively narrower reinforcing ribbon 94 is applied in FIG. 6*g* to the base sheet 89 at a selected location intermediate its edges. Thus, multiple reinforcing ribbons each having different widths may be applied at any desired location across the width of the base sheet through the method of the present invention.

Figure 6H:
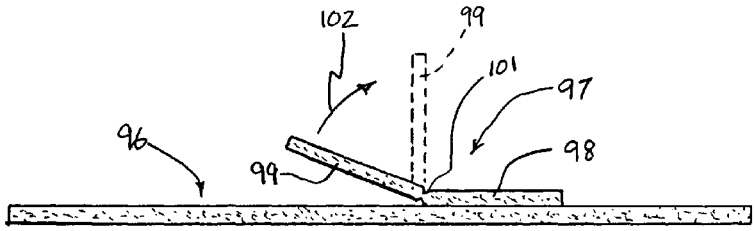

FIG. 6*h* illustrates a unique application of the method of this invention to form internal structures of a carton such as, for example, L-brackets, stiffeners, and separators. A ribbon 97 is applied to a base sheet 96 according to the method of the invention. In this case, however, the method includes applying adhesive along only one side of the ribbon before bonding the ribbon to the paperboard web. The ribbon 97 has a fold line 101 scored therein and the fold line separates the ribbon into a first section 98 and a second section 99. Adhesive is applied to the first section 98, which is bonded to the base sheet 96, and the second section 99 is free to be folded along fold line 101 as indicated by arrow 102 to project in a direction away from the base sheet 96.

The fold line 101 in the ribbon 97 may be scored at the scoring station 24 (FIG. 1) or, alternatively, the ribbon may be pre-scored prior to winding it onto a roll 19. In any case, the second portion 99 of the ribbon functions in the final carton as an internally extending structure. Methods of providing adhesive to only a portion of the ribbon 97 as illustrated in FIG. 6*h* are known in the paperboard industry and may include, for example, masking techniques and/or spraying the adhesive onto the selected portion ribbon as it advances along the fabrication line 11 (FIG. 1).

Figure 7:
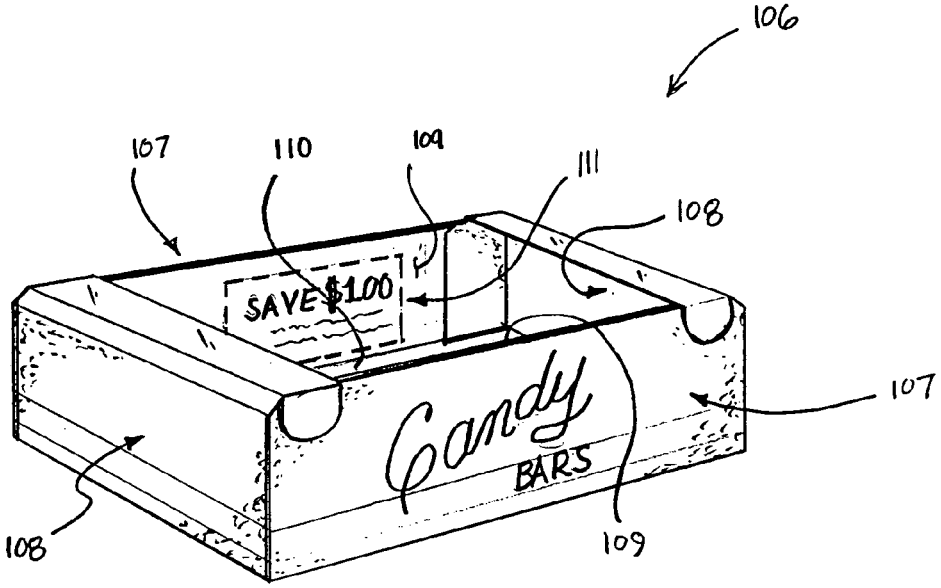
FIG. 7 is a perspective view of one configuration of a carton that embodies principles of the invention illustrating the results of pre-printing ribbons of reinforcing material with indicia according to one embodiment of the invention.

FIG. 7 illustrates one of the many possible configurations of cartons that may be made by the method of the present invention. The carton 106, which may, for example, be a shipping and display container for food items such as candy bars, is converted from a carton blank made according to the invention and has front and back walls 107, end walls 108, and a floor 110. The front and back walls 107 of the carton are structurally reinforced with paperboard reinforcing ribbons 109 applied to the insides of the panels that form the walls 107. Thus, the front and back walls 107 of the carton 106 exhibit enhanced strength and rigidity as a result of the reinforcing ribbons. These properties may be desirable, for example, to enhance the stackability of the cartons when packaged with product, to resist blow-out during shipment, or to provide resistance to tearing in the corners or other high stress locations of the carton.

Further according to the invention, the reinforcing ribbon 109 on the back wall 107 of the carton 106 is seen to have been pre-printed with indicia that is visible on the inside of the carton. Thus, the method of this invention may eliminate the requirement of double sided printing on a carton base sheet when it is desired to display indicia on the inside of a carton. In FIG. 7, the indicia 101 is illustrated as a savings coupon; however, any form of indicia such as, for example, instructions, contests rules, special graphics, or otherwise may be provided. Further, because the reinforcing ribbon is pre-printed, it may be provided with a coated or primed printing surface, which allows high-quality graphics to be printed, on the reinforcing ribbon. This is an economical improvement over previous internal printing, which, as mentioned above, has been somewhat limited in available printing quality.

In addition or as an alternative to the printing of indicia, reinforcing ribbons may be pre-coated if desired with a moisture resistant or other type of coating. In such cases, the method of this invention may be used to make efficiently produced lined cartons for use as alternatives to cartons such a detergent boxes, which traditionally have been supplied with separate individually inserted liners.

Figure 8:
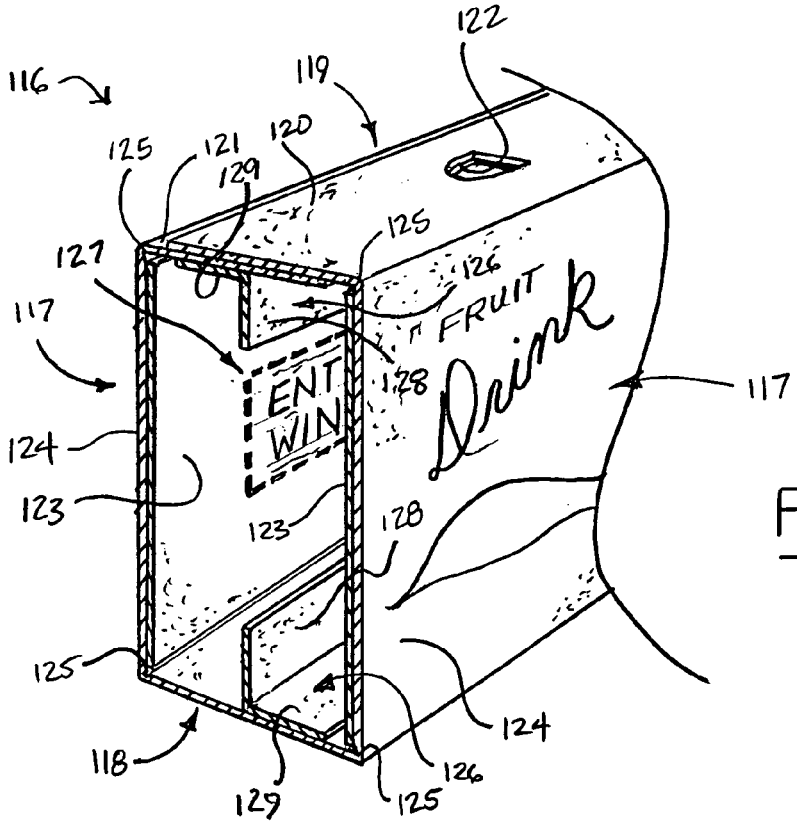
FIG. 8 is a perspective partially sectioned view illustrating another possible configuration of a carton formed by the method of the invention and showing various aspects of the invention.

FIG. 8 illustrates another configuration of a reinforced paperboard carton made according to the method of the invention. The end of the carton is shown in cross-section to illustrate better the internal structural components of the carton. The carton 116, which is illustrated as a carton for packaging fruit drink, is generally rectangular in shape and is folded along fold lines 125 to define side walls 117, a bottom wall 118 and a top wall 119. The top wall 119 is formed by overlapping flaps 120 and 121, which may be secured together by any appropriate means such as with adhesive, and may be provided with a cut-out 122 if desired to form a carrying handle. The side walls 117 have outside surfaces formed by respective panels 124. Reinforcing ribbons 123, which preferably also are made of paperboard, are applied to the side wall panels 124 on the inside of the carton according the invention and form the inside surfaces of the side walls 117. As previously discussed, the reinforcing ribbons 123 enhance the structural integrity of the side walls 117 to provide increased strength and rigidity in the sides of the carton for stackability and resistance to carton blow-out. At least one of the reinforcing ribbons 123 is seen to be printed with indicia 127 that is exposed on the inside of the carton and that may become apparent to a consumer as product is removed from the carton.

Paperboard dividers and stiffeners 126 are applied as described above relative to FIG. 6*h* to the bottom wall 118 and the top wall 119 on the inside of the carton 116. Each of the dividers and stiffeners is formed from a ribbon of paperboard applied according to the method of the invention and has a first portion 129 bonded to the respective wall and a second portion or flap 128 that is folded to extend internally into the carton. The flaps 128 may function to provide structural stiffness to the top and bottom walls and/or to provide spacers or protective separators for articles to be packaged in the carton. Indeed, a wide variety of internal carton structures previously provided by separate and expensive inserts may be made economically, efficiently, and virtually automatically using the method of the present invention.

The invention has been described herein in terms of preferred embodiments and methodologies, which represent the best mode known to the inventors of carrying out the invention. It will be understood by those of skill in the art, however, that many additions, deletions, modifications, and substitutions of equivalent elements not specifically included in the preferred embodiments may be made without departing from the spirit and scope of the invention as set forth in the claims.

What is claimed is:

1. A method of making a paperboard carton blank to be folded to form a carton having a top wall, a bottom wall, and two side walls, the carton having an inside and an outside, the method comprising the steps of:

(a) advancing a web of noncorrugated paperboard along a path, the web of noncorrugated paperboard having a first surface which will be on the inside of the carton when the blank is folded to form the carton, a width, and longitudinally extending panel portions that will each become a plurality of panels, the longitudinally extending panel portions being separated by longitudinal fold lines;

(b) laminating at least a first ribbon and a second ribbon of reinforcing material to the first surface of the advancing web of noncorrugated paperboard, the first ribbon and the second ribbon having a width less than the width of the web of noncorrugated paperboard, the first ribbon being positioned on, and adhered to, substantially all of, but not beyond, a first longitudinally extending panel portion of the web of noncorrugated paperboard, and the second ribbon being positioned on, and adhered to, substantially all of, but not beyond, a second longitudinally extending panel portion of the web, the first ribbon and the second ribbon not extending across the longitudinal fold lines; and (c) cutting the web of noncorrugated paperboard and the laminated first ribbon and second ribbon across their length into a carton blank having panels corresponding to the top wall, the bottom wall, and the two side walls of the carton, whereby the first ribbon and the second ribbon are positioned on the inside of the carton when the carton blank is folded to form the carton, and reinforce the carton blank.

2. The method of claim 1 wherein at least one of the first ribbon or the second ribbon of reinforcing material comprises paperboard.

3. The method of claim 2 and wherein at least one of the first ribbon or the second ribbon of paperboard comprises paperboard trim.

4. The method of claim 2 wherein at least one of the first ribbon or the second ribbon of paperboard comprises paperboard cull.

5. The method of claim 1 and wherein step (b) comprises advancing the first ribbon and the second ribbon of reinforcing material along paths, applying adhesive to the first ribbon and the second ribbon of reinforcing material, and bringing the first ribbon and the second ribbon into contact with the web to adhere the first ribbon and the second ribbon to the web.

6. The method of claim 1 wherein at least a first edge panel portion extends along opposed edges of the noncorrugated paperboard web and wherein the first ribbon of reinforcing material is positioned within the first edge panel portion.

7. The method of claim 1 wherein the web of noncorrugated paperboard has opposed edges wherein the first panel portion extends along the web intermediate the opposed edges, the first ribbon of reinforcing material being applied within the first panel portion.

8. The method of claim 1 wherein an additional ribbon of reinforcing material is applied atop the first ribbon or the second ribbon of reinforcing material to form multiple layers of reinforcing material.

9. A method of making a paperboard carton having a top wall, a bottom wall, and two side walls, the carton having selectively reinforced panels, said method comprising the steps of (a) advancing a web of noncorrugated paperboard along a path, the web of noncorrugated paperboard having a width and longitudinally extending panel portions that will each become a plurality of panels, the longitudinally extending panel portions being separated by longitudinal fold lines;

(b) progressively applying and adhering at least a first ribbon and a second ribbon of reinforcing material to the advancing web of noncorrugated paperboard, the first ribbon and the second ribbon having a width less than the width of the web of noncorrugated paperboard, the first ribbon being positioned to overlie and adhere to substantially all of, but not beyond, a first selected longitudinally extending panel portion of the web, and the second ribbon being positioned to overlie and adhere to substantially all of, but not beyond, a second selected longitudinally extending panel portion of the web, the first ribbon and the second ribbon not extending across the longitudinal fold lines;

(c) cutting the web of noncorrugated paperboard to form a carton blank having panels corresponding to the top wall, the bottom wall, and the two side walls of the carton; and (d) forming the blank into the carton for receiving articles, the carton having an inside and an outside, the first ribbon and the second ribbon of reinforcing material reinforcing the carton and being positioned on the inside of the carton.

10. The method of claim 9 wherein at least one of the first ribbon or the second ribbon of reinforcing material comprises noncorrugated paperboard.

11. The method of claim 9 wherein step (b) further comprises advancing the first ribbon and the second ribbon of reinforcing material along a path, applying adhesive to the advancing first ribbon and the advancing second ribbon, and progressively bringing the first ribbon and the second ribbon into engagement with the advancing web of noncorrugated paperboard to adhere the first ribbon and the second ribbon to the web.

12. The method of claim 9 wherein the longitudinally extending panel portions include a first edge panel portion and a second edge panel portion, the first edge panel portion and the second edge panel portion extending along opposed edges of the web of paperboard and wherein at least the first ribbon is positioned to overlie substantially all of, but not beyond, the first edge panel portion.

13. The method of claim 9 wherein step (b) further comprises applying and adhering atop the first ribbon or the second ribbon of reinforcing material an additional ribbon of reinforcing material to form a double thickness of reinforcing material.

14. The method of claim 9 wherein the longitudinal fold lines include a first longitudinal fold line and a second longitudinal fold line, wherein an intermediate longitudinally extending panel portion extends between the first longitudinal fold line and the second longitudinal fold line, and wherein the first ribbon is positioned to overlie substantially all of, but not beyond, the intermediate panel portion.

15. The method of claim 9 further comprising the step of printing indicia on at least one of the first ribbon or the second ribbon of reinforcing material, the indicia being visible from the inside of the carton formed in step (d).

16. The method of claim 15 wherein the indicia is printed on at least one of the first ribbon or the second ribbon of reinforcing material before being applied and adhered to the web of noncorrugated paperboard in step (b).

17. The method of claim 9 further comprising the step of scoring fold lines to separate the longitudinally extending panel portions of the web of noncorrugated paperboard.

18. The method of claim 17 wherein the first ribbon or the second ribbon of reinforcing material has an edge and wherein the step of scoring fold lines includes forming at least one fold line adjacent the edge of the first ribbon or the second ribbon.

19. The method of claim 9 where at least one of the first ribbon or the second ribbon of reinforcing material comprises paperboard trim.

20. The method of claim 9 wherein at least one of the first ribbon or the second ribbon of reinforcing material comprises paperboard cull.

21. The method of claim 9, wherein the longitudinal fold lines are on the same side of the web as the first ribbon and the second ribbon.

22. The method of claim 9, wherein step (b) includes progressively applying and adhering at least a third ribbon to the advancing web, the third ribbon being positioned not to overlie any of the longitudinal fold lines, the third ribbon having a first portion adhered to the web and a second portion not adhered to the web, whereby the second portion of the third ribbon is capable of being folded in a direction away from the web.

23. The method of claim 22, wherein the first portion and the second portion of the third ribbon are divided by a fold line.

24. The method of claim 22, wherein the first portion and the second portion of the third ribbon are divided by a longitudinally extending fold line, and the second portion of the third ribbon extends between the fold line and one edge of the third ribbon.

25. The method of claim 22, wherein at least a third ribbon is positioned on the inside of the carton.

* * * * *

UNITED STATES PATENT AND TRADEMARK OFFICE

CERTIFICATE OF CORRECTION

PATENT NO. : 8,317,671 B1
APPLICATION NO. : 09/559704
DATED : November 27, 2012
INVENTOR(S) : Michael D. Zoeckler It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1,826 days.

Signed and Sealed this
Twentieth Day of August, 2013

Teresa Stanek Rea
*Acting Director of the United States Patent and Trademark Office*